US005203988A

United States Patent [19]

Swan, III et al.

[11] Patent Number: 5,203,988

[45] Date of Patent: Apr. 20, 1993

[54] MULTISTAGE REFORMING WITH ULTRA-LOW PRESSURE CYCLIC SECOND STAGE

[75] Inventors: George A. Swan, III, Baton Rouge, La.; James P. Bailor, Kenvil, N.J.; David W. Staubs; Eduardo Mon, both of Baton Rouge, La.

[73] Assignee: Exxon Research & Engineering Company, Florham Park, N.J.

[21] Appl. No.: 747,897

[22] Filed: Aug. 19, 1991

[51] Int. Cl.[5] ..... C10G 35/04

[52] U.S. Cl. ..... 208/65; 208/63; 208/64

[58] Field of Search ..... 208/65

[56] References Cited

U.S. PATENT DOCUMENTS

| | | | |
|---|---|---|---|
| 3,640,818 | 2/1972 | Hamner | 208/65 |
| 3,748,255 | 7/1973 | Cassidy et al. | 208/65 |
| 3,748,256 | 7/1973 | Ko et al. | 208/65 |
| 3,748,259 | 7/1973 | Cassidy et al. | 208/65 |
| 3,864,240 | 2/1975 | Store | 208/65 |
| 3,883,418 | 5/1975 | Drehmann | 208/65 |
| 3,992,465 | 11/1976 | Juguin et al. | 208/65 |
| 4,155,843 | 5/1979 | Gallagher | 208/65 |
| 4,167,473 | 9/1979 | Sikonia | 208/64 |
| 4,206,035 | 6/1980 | Hutson, Jr. et al. | 208/65 |
| 4,737,262 | 4/1980 | Franck et al. | 208/65 |
| 4,808,457 | 2/1989 | Nyan | 208/65 |
| 4,832,821 | 5/1989 | Swan, III | 208/65 |
| 4,872,867 | 10/1989 | Clem | 208/65 |
| 4,975,178 | 12/1990 | Chen et al. | 208/65 |
| 4,992,158 | 2/1991 | Schweizer | 208/65 |

*Primary Examiner*—Helane Myers

*Attorney, Agent, or Firm*—Penny L. Prater; Henry E. Naylor

[57] ABSTRACT

Disclosed is a process for catalytically reforming a gasoline boiling range hydrocarbonaceous feedstock. The reforming is conducted in multiple stages with heavy aromatics removal between the first and second stages.

27 Claims, 2 Drawing Sheets

MULTISTAGE REFORMING WITH ULTRA-LOW PRESSURE CYCLIC SECOND STAGE

FIELD OF THE INVENTION

The present invention relates to a process for catalytically reforming a gasoline boiling range hydrocarbonaceous feedstock. The reforming is conducted in multiple stages with heavy aromatics removal between the first and second stages.

BACKGROUND OF THE INVENTION

Catalytic reforming is a well established refinery process for improving the octane quality of naphthas or straight run gasolines. Reforming can be defined as the total effect of the molecular changes, or hydrocarbon reactions, produced by dehydrogenation of cyclohexane, dehydroisomerization of alkylcyclopentanes, and dehydrocyclization of paraffins and olefins to yield aromatics: isomerization of n-paraffins; isomerization of alkylcycloparaffins to yield cyclohexanes: isomerization of substituted aromatics; and hydrocracking of paraffins which produces gas, and inevitably coke, the latter being deposited on the catalyst. In catalytic reforming, a multifunctional catalyst is usually employed which contains a metal hydrogenation-dehydrogenation (hydrogen transfer) component, or components usually platinum, substantially atomically dispersed on the surface of a porous, inorganic oxide support, such as alumina. The support, which usually contains a halide, particularly chloride, provides the acid functionality needed for isomerization, cyclization, and hydrocracking reactions.

Reforming reactions are both endothermic and exothermic, the former being predominant, particularly in the early stages of reforming with the latter being predominant in the latter stages. In view thereof, it has become the practice to employ a reforming unit comprises of a plurality of serially connected reactors with provision for heating of the reaction stream from one reactor to another. There are three major types of reforming: semi-regenerative, cyclic, and continuous. Fixed-bed reactors are usually employed in semi-regenerative and cyclic reforming and moving-bed reactors in continuous reforming. In semi-regenerative reforming, the entire reforming process unit is operated by gradually and progressively increasing the temperature to compensate for deactivation of the catalyst caused by coke deposition, until finally the entire unit is shutdown for regeneration and reactivation of the catalyst. In cyclic reforming, the reactors are individually isolated, or in effect swung out of line, by various piping arrangements. The catalyst is regenerated by removing coke deposits, and then reactivated while the other reactors of the series remain on stream. The "swing reactor" temporarily replaces a reactor which is removed from the series for regeneration and reactivation of the catalyst, which is then put back in the series. In continuous reforming, the reactors are moving-bed reactors, as opposed to fixed bed reactors, which continuous addition and withdrawal of catalyst and catalyst is regenerated in a separate regeneration vessel.

Through the years, many process variations have been proposed to improve such things as $C_5+$ liquid (a relatively high octane product stream) yield and/or octane quality of the product stream from catalytic reforming. For example, if a product of high octane is desired, e.g. 100 or higher RON (research octane number), the severity of reforming must be increased. This can generally be accomplished by reducing the space velocity or increasing reaction temperature. While increasing severity for obtaining a higher octane product is desirable, it has disadvantages. For example, high severity usually: (i) reduces the yield of $C_5+$ as a percent of the naphtha feedstock; (ii) usually causes more rapid accumulation of coke on the catalyst, requiring more frequent regeneration.

Practice of the present invention results in a significantly higher yield of hydrogen and of $C_5+$ liquid as a percent of the naphtha feedstock. This is achieved by conducting the reforming in multiple stages and separating an aromatics-rich (high octane) stream between stages. The separation is performed after reforming at low severity, in a first stage or stages, to convert most of the alkylcyclohexanes and alkylcyclopentantes to aromatics with minimum cracking of paraffins.

Heavy aromatic fractions such as $C_9$ and $C_{10}$ are removed between the first and second stages. The remaining portion of the stream which may be rich in $C_6$–$C_8$ aromatics, is processed in the downstream stage or stages, at relatively low pressures.

While there are some references in the art teaching interstage aromatics removal, only U.S. Pat. No. 4,872,967 specifically suggests aromatic removal followed by low pressure reforming of the remaining fraction. U.S. Pat. No. 4,872,967 teaches interstage aromatics separation without reference to specific aromatic types. It further teaches low pressure reforming of an "aromatics-lean" stream in the next stage. In the present invention, primarily $C_9+$ or $C_{10}+$ aromatics are removed between stages. The resulting second stage feed is not aromatics lean and could actually contain more aromatics than paraffins. Most of these aromatics are of the $C_6$–$C_8$ range. The feed to the second stage may possibly be composed of more than 50 wt. % $C_6$–$C_8$ aromatics. An increase in aromatics content of the second stage feed aids in the promotion of catalyst selectivity. Furthermore, selective removal of heavy ($C_9+$ or $C_{10}+$) aromatics reduces deactivation of the second stage catalyst, more so than non-selective aromatics removal (with respect to carbon numbers) as taught in U.S. Pat. No. 4,872,967. While U.S. Pat. No. 4,872,967 teaches minimum conversion of paraffins and substantial conversion of naphthenes to aromatics in the first stage, this invention teaches substantial conversion of paraffins and naphthenes.

Some references in the art prior to U.S. Pat. No. 4,872,967 teach aromatics removal from feed between and after reactors of a reforming process unit. U.S. Pat. No. 2,970,106 teaches reforming to a relatively high octane (99.9 RON) followed by two stage distillation to produce three different streams: a light, intermediate, and heavy boiling stream. The intermediate stream, which contains $C_7$ and $C_8$ aromatics, is subjected to permeation by use of a semipermeable membrane resulting in an aromatics-rich stream and an aromatics-lean stream, both of which are distilled to achieve further isolation of aromatics. It is also taught that the aromatics-lean stream from the permeation process may be combined with a low octane stream from hydroformate distillation and further hydroformed, or isomerized, to improve octane number. It is further taught that the total hydroformate may be processed using the permeation process. Partial or low severity reforming, followed by heavy aromatics separation, followed by further reforming of the remaining stream is not suggested in U.S. Pat. No. 2,970,106. Operation of the first-stage at high octane (99.9 RON) would result in very high conversion of feed paraffins. For example, a key paraffin, n-heptane and its various isomers, would be about 46 to 54% converted at 99.9 RON for a petroleum naphtha cut (185°/330° F. ) comprised of 59% paraffins, 27% naphthenes, and 14% aromatics, which percents are liquid volume percent on total paraffins, naphthenes and aromatics present in the feed. In accordance with the process of the present invention, conversion of the N-heptane and its various isomers would be only about 11 to 14% in the first reforming stage-thus allowing more selective (less paraffin cracking) conversion to aromatics in the lower pressure second-stage.

Also, U.S. Pat. No. 3,883,418 teaches reforming a feedstock in the presence of hydrogen over a bifunctional catalyst in a first stage to convert naphthenes to aromatics, followed by distillation of the first stage product to produce an intermediate boiling (120°-260° F.) material which is subjected to extractive distillation to produce an aromatics-rich, exact and an aromatics-lean raffinate. The aromatics-lean or paraffins-rich, raffinate is then reformed in the presence of steam over a steam-stable catalyst. Stem reforming employs a steam reaction atmosphere in the presence of a catalyst having a relatively low surface area aluminate support material. Reforming in accordance with the present invention, employs a hydrogen reaction atmosphere, in the substantial absence of steam, and in the presence of a catalyst having a relatively high surface area support material, such as gamma alumina.

Further, U.S. Pat. No. 4,206,035 teaches a process similar to U.S. Pat. No. 3,883,418 except that solvent extraction is used to remove aromatics instead of extractive distillation, and the aromatics-lean fraction sent to steam reforming is restricted to carbon numbers between 5 and 9. Also, specific hydrogen to hydrocarbon ratios and steam to hydrocarbon ratios are required.

U.S. Pat. No. 2,933,445 teaches a catalytic reforming process wherein the entire feedstock is first fractionated. The resulting 140° to 210° F. and 260° to 420° F. fractions are reformed in the presence of hydrogen in parallel reformers. In the reforming of the 140° to 210° F. fraction, the reforming severity is set such that naphthenes are converted to benzene and toluene and the resulting reformate is treated to remove aromatics. The remaining stream, containing at least 80 percent paraffins (primarily those containing 6 and 7 carbon atoms) is blended with the heavy 260° to 420° F. fraction and reformed in a second reformer. This reference teaches restricting the hydrocarbons reformed prior to aromatics removal to only the light naphtha components which form $C_6$ and $C_7$ aromatics. In addition, it teaches further reforming of the light paraffin-rich stream remaining after aromatics removal, in admixture with a heavy feed which is rich in aromatics and naphthenes.

Further, U.S. Pat. No. 3,640,818 teaches a process wherein virgin and cracked naphthas are reformed in a first stage and the reaction stream passed to solvent extraction where aromatics are removed. The paraffinic-rich raffinate is passed to second stage reforming, preferably at pressures the same or higher than the first stage.

SUMMARY OF THE INVENTION

In accordance with the present invention, there is provided a process for catalytically reforming a gasoline boiling range hydrocarbon feedstock in the presence of hydrogen in a reforming process unit comprised of a plurality of serially connected reactors wherein each of the reactors contains at least one multimetallic reforming catalyst containing a Group VIII noble metal. The catalyst may be either monofunctional or bifunctional. The process comprises:

a) conducting the reforming in two or more stages comprises of one or more reactors;
b) removing at least a portion of the $C_9$+ aromatics between stages to produce a stream comprising substantially $C_8$ and lower carbon number aromatics as well as unconverted paraffins;
c) passing at least a portion of this stream to the next downstream stage; and
d) conducting the reforming in one or more downstream stages at a pressure lower than the first stage wherein at least one reactor, or one or more of the downstream reactors, contains a bifunctional Pt - containing reforming catalyst.

In a preferred embodiment of the present invention, the first stage of this invention may employ from 1 to 3 reforming reactors operated in semi-regenerative mode. A compressor is used to recycle gaseous products. To obtain semi-regenerative operation, the first stage pressure is preferably above 175 psig.

In another preferred embodiment, the process is a two stage process wherein gaseous products from the first stage are cascaded through the reactors in once-through mode to the second stage.

In still another preferred embodiment, a second compressor is used to recycle gas throughout the second stage if the hydrogen produced in the first stage is insufficient to meet the desired second stage run length. Alternatively, an independent hydrogen-rich stream may be routed in a once-through mode to the second stage.

The latter embodiment may be particularly desirable if only aromatics larger than $C_{10}$+ are being removed. With either embodiment, $C_9$+ or $C_{10}$+ aromatics removal can be performed by fractionation, extraction or distillation techniques. Fractionation may be employed alone or it may be followed by solvent extraction to remove unreformed paraffins from the fractionation bottoms. These paraffins would then be sent to the second stage reformer. Alternately, extraction or azeotropic distillation may be employed to maximize paraffin recovery from the distillation bottoms.

In yet other preferred embodiments of the present invention, the catalyst composition of the one or more downstream stages is comprised of a Group VIII noble metal, a halide, an inorganic oxide support, and one or more promoter metals selected from those of Groups IIIA, IVA, IB, VIB, and VIIB of the Periodic Table of the Elements.

Extractive or axeotropic distillation, or alternatively, fractionation followed by solvent extraction would provide a heavy stream in which paraffins would be substantially absent. Such a stream would be especially useful in octane blending. Furthermore, a relatively high concentration of light aromatics in the feed to the second stage is beneficial in mitigating the hydrocracking activity of the reforming catalyst, particularly at high catalyst metal loadings.

DETAILED DESCRIPTION OF THE INVENTION

Feedstocks which are suitable for reforming in accordance with the instant invention are any hydrocarbonaceous feedstock boiling in the gasoline range. Nonlimiting examples of such feedstocks include the light hydrocarbon oils boiling from about 70° F. to about 500° F., preferably from about 180° F. to about 400° F., for example straight run naphtha, synthetically produced naphtha such as a coal or oil-shale derived naphtha, thermally or catalytically cracked naphtha, or blends or fractions thereof.

Figure 1:
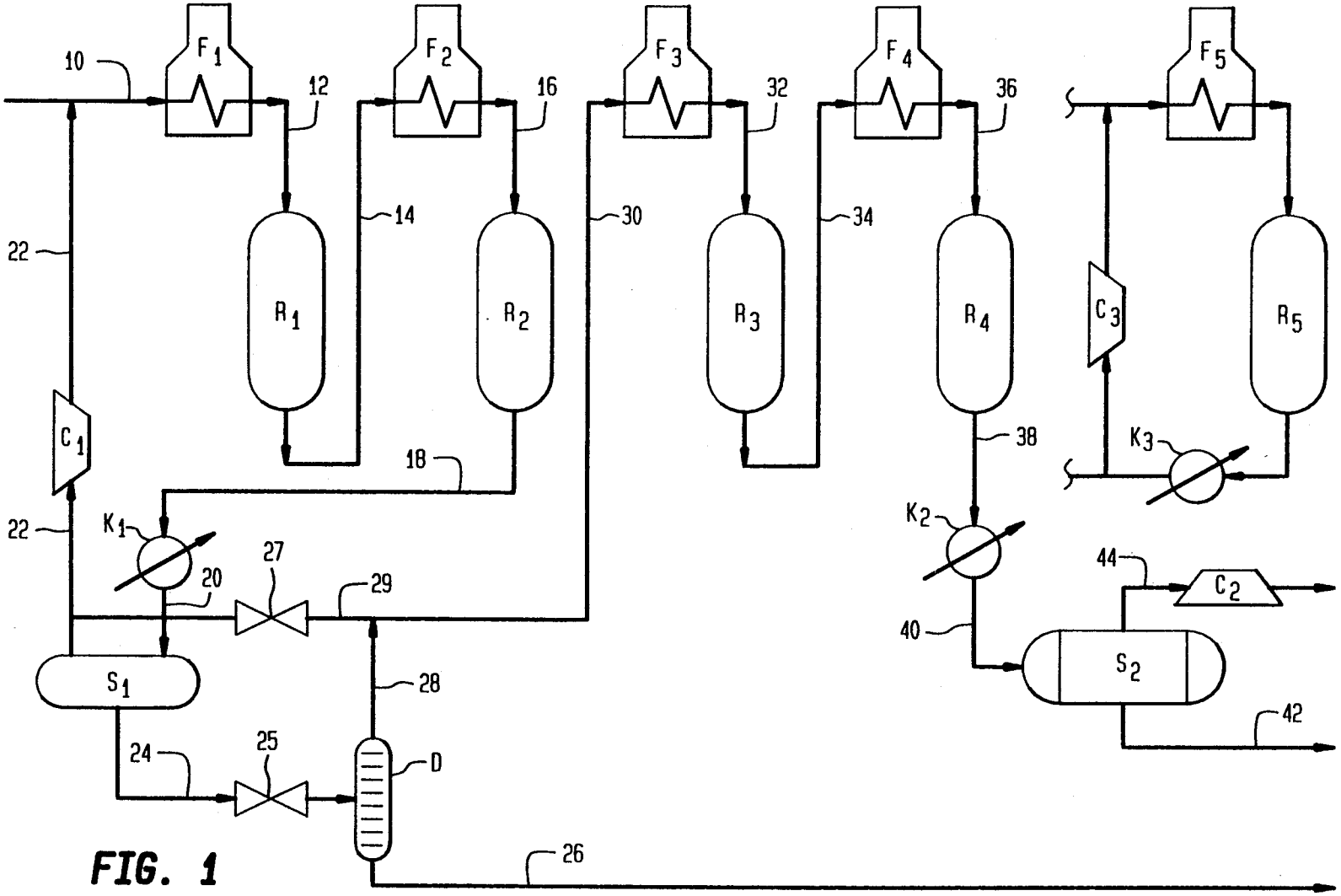
FIG. 1 hereof depicts a simplified flow diagram of a preferred reforming process unit of the present invention. The reforming process unit is comprised of a first stage which includes a lead reactor and a first downstream reactor operated in semi-regenerative mode, wherein the reaction stream of the first stage is separated into a stream rich in heavy aromatics ($C_9$+ or $C_{10}$+) and a stream rich in lighter aromatics and paraffins. The later stream is passed to a second reforming stage which includes two serially connected downstream reactors operated in cyclic mode with a swing reactor.
Figure 2:
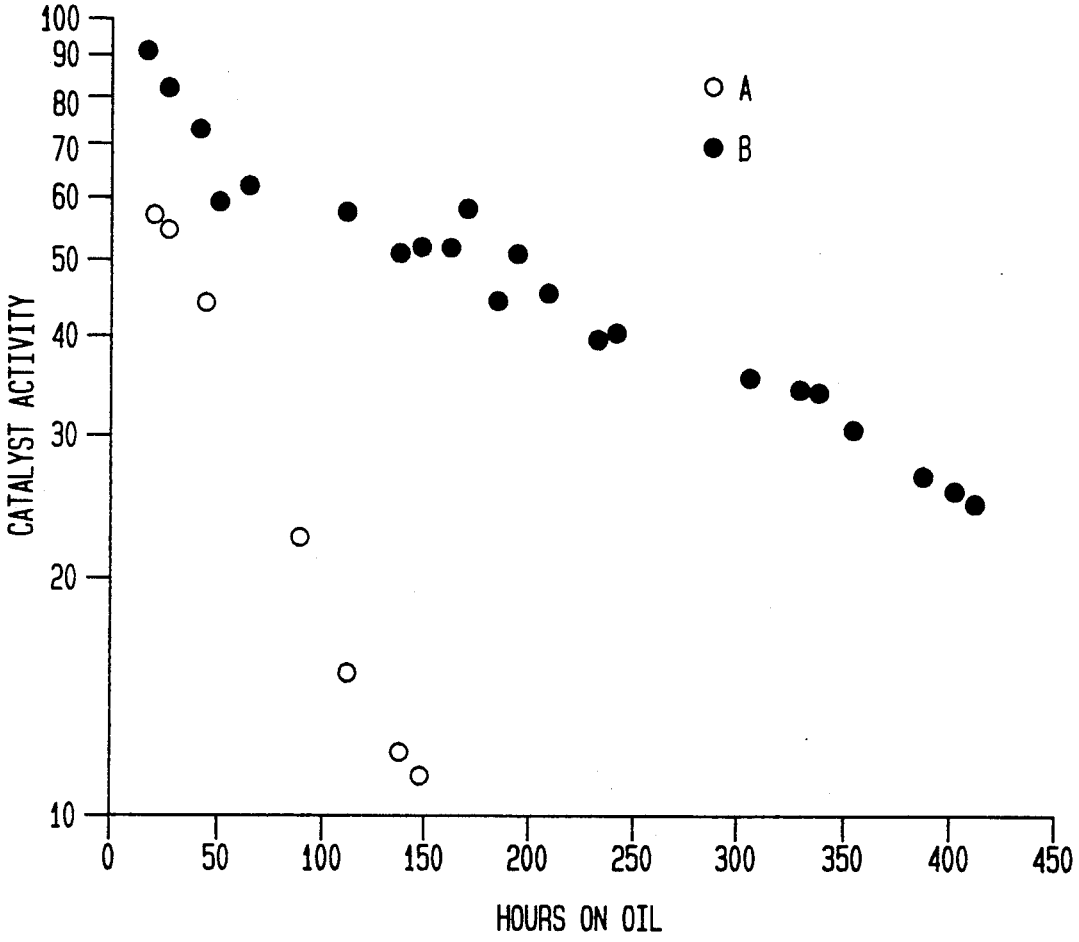
FIG. 2 hereof shows pilot plant data that illustrate how heavy aromatics removal benefits catalyst activity maintenance. Curve A shows the drastic activity decay that results when full range first stage product (56 wt % $C_6$–$C_{10}$ aromatics), is reformed at low pressure (100 psig 1.3:1 $H_2$: oil mole ratio) over conventional Pt-Re/$Al_2O_3$ catalyst. Curve B shows the substantial improvement in decay rate that results when the fraction of first stage product boiling below 310° F. (40 wt. % $C_6$–$C_8$ aromatics), is reformed at comparable conditions over the same catalyst. In the latter case, primarily $C_9$+ aromatics were removed from the first stage product by distillation.

Referring to FIG. 1, a feedstock, which preferably is first hydrotreated by any conventional hydrotreating method to remove undesirable components such as sulfur and nitrogen, is passed to a first reforming stage represented by heater or preheat furnaces $F_1$ and $F_2$, and reactors $R_1$ and $R_2$. A reforming stage, as used herein, is any one or more reactors and its associated equipment (e.g., preheat furnaces etc.) separated from an immediately preceding or succeeding stage by the separation of heavy aromatics from the reaction stream of the preceding stage. The feedstock is fed into heater, or preheat furnace, $F_1$ via line 10 where it is heated to an effective reforming temperature. That is, to a temperature high enough to initiate and maintain dehydrogenation reactions, but not so high as to cause excessive hydrocracking. The heated feedstock is then fed, via line 12, into reactor $R_1$ which contains a catalyst suitable for reforming. Reactor $R_1$, as well as all other reactors in the process unit, is operated at reforming conditions. Typical reforming operating conditions that can be used for an of the reactors of any of the stages hereof are such that the reactor inlet temperature is from about 800° to about 1200° F.; the reactor pressure from about 30 psig to about 1,000 psig, preferably from about 300 psig to about 450 psig in the first stage, and from about 100 psig to about 200 psig in the second stage; a weight hourly space velocity (WHSV) of about 0.5 to about 20, preferably from about 1 to about 10 and a hydrogen to oil ratio of about 1 to 10 moles of hydrogen per mole of $C_5$+ feed.

The reaction product of reactor $R_1$ is fed to preheat furnace $F_2$ via line 14, then to reactor $R_2$ via line 16. The reaction product from the first stage is sent to cooler $K_1$ via line 18 where it is cooled to condense the liquid to a temperature within the operating range of the aromatics separation unit. This temperature will generally range from about 100° to about 300° F. The cooled reaction product is then fed to separator $S_1$ via line 20 where a lighter gaseous stream is separated from a heavier liquid stream. The gaseous stream, which is hydrogen-rich, is recycled, via line 22, to line 10 by first passing it through compressor $C_1$ to increase its pressure to feedstock pressure. Of course, during startup, the unit is pressured-up with hydrogen from an independent source until enough hydrogen can be generated in the first stage, or stages, for recycle. It is preferred that the first stage be operated in semi-regenerative mode.

The liquid fraction from separator $S_1$ is passed via line 24, through pressure reduction valve 25, to distillation facility D comprised of one or more fractionation towers which can contain multiple stages. An overhead stream and a bottoms stream 26 are obtained. The bottoms stream 26 which exits the distillation facility is rich in aromatics of carbon number 9 or 10 and greater, and has a relatively high octane value. Thus, it can be used as a high octane blending stock, or it can be used as a source of raw material for chemical feedstocks. The overhead stream 28 is characterized by a low concentration of heavier, higher boiling aromatics of carbon number 9 or 10 and above, while it is richer in benzene, toluene, and xylenes as well as in unreformed paraffins. Overhead stream 28 is mixed with the hydrogen-rich gaseous product of the first stage via line 29 which passes from the separator and through pressure reduction valve 26; then the combined stream 30 is routed to a second reforming stage by passing it through furnace $F_3$ via line 30 where it is heated to reforming temperatures.

The heated stream from furnace $F_3$, containing lighter aromatics and paraffins, is introduced into reactor $R_3$ and then passed to furnace $F_4$ via line 34 then to reactor $R_4$ via line 36. Reactors $R_3$ and $R_4$ also contain a reforming catalyst composition, which can be the same as that used in the first reforming stage. Furthermore, any reactor, or portion thereof, of any stage may contain a reforming catalyst different than that of any other reactor so long as at least one reactor of a downstream stage contains a reforming catalyst containing a noble metal. Product from reactor $R_4$ is passed to cooler $K_2$ via line 38 where it is cooled and sent via line 40 to separator $S_2$ where it is separated into a liquid stream 42 and a hydrogen-rich make-gas stream 44 which is passed through compressor $C_2$ after which it leaves the process unit or can be recycled. It is preferred that the second stage be operated in cyclic mode with swing reactor $R_5$, regeneration furnace compressor $C_3$, and cooler $K_3$. The second stage, as well as any additional downstream stages, is operated at a pressure at least 25 psig lower than the first stage, more preferably at a pressure less than about 200 psig total pressure. While the figure shows only two reactors on oil for both stages, it is understood that any number of reactors can be used. Of course, economics will dictate the number of reactors and stages employed commercially.

It is also to be understood that the figure hereof sets forth a preferred mode of practicing the instant invention and as such, many variations of the process scheme illustrated in the figure can be practiced and still be within the scope of the invention. For example, at least a portion of the reaction stream from stage two can be recycled through the fractionator between stages one and two or it can be separated in a fractionator following stage two and the resulting aromatics-lean stream recycled to the second stage reactors. Further, a three stage reforming process can be employed with a heavy aromatics separation unit between stages one and two as well as an aromatics separation unit following the third stage with the resulting aromatics-lean stream from this third aromatics separation unit recycled to the reactors of the third stage.

Catalysts suitable for use herein include both monofunctional and bifunctional, monometallic and multimetallic noble metal containing reforming catalysts. Preferred are the bifunctional reforming catalysts comprised of a hydrogenation-dehydrogenation function and an acid function. The acid function, which is important for isomerization reactions, is thought to be associated with a material of the porous, adsorptive, refractory oxide type which serves as the support, or carrier, for the metal component, usually a Group VIII noble metal, preferably Pt, to which is generally attributed the hydrogenation-dehydrogenation function. Preferably the Group VIII noble metal is platinum. One or more promoter metals selected from metals of Groups IIIA, IVA, IB, VIB, and VIIB of the Periodic Table of the Elements may also be present. The promoter metal, can be present in the form of an oxide, sulfide, or elemental state in an amount from about 0.01 to about 5 wt. %, preferably from about 0.1 to about 3 wt. % and more preferably from about 0.2 to about 3 wt. %, calculated on an elemental basis, and based on the total weight of the catalyst composition. It is also preferred that the catalyst compositions have a relatively high surface area, for example about 100 to 250 $m_2/g$. The Periodic Table of which all the Groups herein refer to can be found on the last page of Advanced Inorganic Chemistry, 2nd Edition, 1966, Interscience publishers, by Cotton and Wilkinson.

The halide component which contributes to the necessary acid functionality of the catalyst may be fluoride, chloride, iodide, bromide, or mixtures thereof. Of these, fluoride, and particularly chloride, are preferred. Generally, the amount of halide is such that the final catalyst composition will contain from about 0.1 to about 3.5 wt. %, preferably about 0.5 to about 1.5 wt. % of halogen calculated on an elemental basis.

Preferably, the platinum group metal will be present on the catalyst in an amount from about 0.01 to about 5 wt. %, calculated on an elemental basis, of the final catalytic composition. More preferably the catalyst comprises from about 0.1 to about 2 wt. % platinum group component, especially about 0.1 to 2 wt. % platinum. Other preferred platinum group metals include palladium, iridium, rhodium, osmium, ruthenium and mixtures thereof.

U.S. Pat. No. 4,872,967 notes that aromatics removal can be accomplished by a variety of techniques, including extraction,, extractive distillation, distillation, absorption, by use of a semipermeable membrane or any other appropriate method for the removal of aromatics or paraffins. The use of a semipermeable membrane is preferred in U.S. Pat. No. 4,872,967. The present invention employs a distillation scheme to separate heavier aromatics from lighter aromatics. It has been found that distillation procedures remove aromatics more selectively from second stage feed than do membranes.

The economically preferred distillation facility comprises two conventionally designed towers: a depentanizer and a reformate splitter. Use of a single fractionation tower with a sidestream is another option, but is less attractive because more stages are required to effect the necessary separation. First stage high pressure separator bottoms stream is fed to the depentanizer, whose purpose is to remove $C_5$ and lighter components. The depentanizer operates between 50 and 200 psig and contains 20–40 trays. The overhead temperature is maintained at 100°–110° F. The bottoms stream from the depentanizer is routed to the reformate splitter operating at lower pressure, typically 10–20 psig, with 30–50 trays. The reboiler and overhead condenser are operated so as to maintain the desired endpoint of second stage feed, which is the overheat stream from this tower. The bottoms stream from the reformate splitter is rich in $C_9+$ or $C_{10}+$ aromatics, with initial ASTM boiling point greater than about 290° F.

A second stage stream containing a substantial fraction of lower boiling aromatics as well as paraffins has been found to produce overall greater hydrogen and $C_5+$ liquid yields than an "aromatics-lean" stream, because these aromatics enhance selectivity by reducing paraffin cracking.

By practice of the present invention, reforming is conducted more efficiently and results in increased hydrogen and $C_5+$ liquid yields as well as increased yields of heavy aromatics. That is, the reactors upstream of heavy aromatics separation are operated at conventional reforming temperatures and pressures while the reactors downstream of the aromatics removal, because of the removal of a substantial portion of first stage product as a heavy aromatics-rich stream, can be operated at lower pressures. Such pressures may be from as low as about 30 psig to about 100 psig. In addition, because of the removal of this stream rich in heavier aromatics, the reactors downstream to their removal can be operated without recycling hydrogen-rich make-gas. More particularly, the downstream reactors can be operated in once-through gas mode because there is an adequate amount of hydrogen generated, that when combined with the hydrogen-rich gas from the reactors of the previous stage, is an adequate amount of hydrogen to sustain the reforming reactions taking place.

The downstream reactors, operating in the once-through hydrogen-rich gas mode, permit a smaller product-gas compressor ($C_2$ in the Figure) to be substituted for a larger capacity recycle gas compressor. Pressure drop in the second stage is also reduced by virtue of once-through gas operation.

Further, as previously discussed, practice of the present invention allows for a dual mode of operation wherein the stage upstream of heavy aromatics separation can be operated in semi-regenerative mode and the stage downstream of heavy aromatics separation can be operated in cyclic mode. The frequency of regeneration of the downstream stage is decreased because the stream deplete of $C_9+$ or $C_{10}+$ aromatics is less susceptible to coking when compared with an unseparated first stage product stream. A still further benefit of the instant invention is the fact that two octane streams are produced. The stream rich in heavy aromatics is exceptionally high in octane number, for example, up to about 108 RON, or higher, and the octane number of the product stream from the downstream stage is flexible depending on the octane requirements for gasoline blending. These two independent octane streams allow for increased flexibility.

Another benefit of the present invention is that because the heavy aromatics stream is high in octane number, the downstream reactors may be operated at lower octane severity, and thereby achieve lower coking rates, as well as longer catalyst life between regenerations. This lower severity also results in less undesirable polynulear aromatic side products. An additional benefit of the present invention is that the heavy aromatics-rich stream provides more flexibility for motor gasoline blending. Also, the second stage reformate can be more easily separated into high value chemicals feedstocks such as benzene, toluene, and xylene.

The present invention will be more fully understood, and appreciated by reference to the following examples which are presented for illustrative purposes and not intended to define the scope of the invention.

EXAMPLES

Comparative Example A

A conventional high pressure reformer operating at 410 psig and 2.5 kSCF/B (thousand standard cubic feed per barrel) recycle gas rate with 0.3 wt. % Pt/0.3 wt. % Re catalyst was simulated in a pilot plant with four adiabatic reactors in series. The feedstock was a blend of Arabian Light and North Sea naphthas with nominal boiling range of 160°/325° F. and the following properties:

| | |
|---|---|
| API Gravity | 57.1 |
| Paraffins, vol. % | 57.8 |
| Naphthenes, vol. % | 27.5 |
| Aromatics, vol. % | 14.7 |

The pilot unit was operated to maintain 102 Research Octane Number Clear (RONC) product for over 200 hours and obtain average $C_5+$ liquid and hydrogen yields which are shown in Table 1.

Example 1

The same pilot plant used in Example 1 was modified to operate in two stages. The first two reactors comprised the first stage with product separation and collection facilities added; the third and fourth reactors constituted the second stage. Appropriate process modifications were completed to effect first stage operation at high pressure with recycle gas; and one-through hydrogen, low pressure operation of the second stage. The same Pt-Re catalyst of Example 1 was utilized, with the same naphtha feed to the first stage. First stage reformate was fractionated to produce a partially reformed naphtha boiling between 100° F. and 310° F. for second feed, and a heavy aromatics stream with an RONC of 105. Conditions for each stage were:

| | Stage 1 | Stage 2 |
|---|---|---|
| Pressure, psig | 325 | 100 |
| Gas Rate (kSCF/B) | 2.0 (Recycle) | 1.1-1.2 (Once-through) |
| Average Temp, °F. | 900-930 | 930-940 |
| Product RONC | 84.6 | 101.8 |

Operating conditions in each stage were tailored to produce the same overall octane as in Example 1 (RONC=102) when the second stage reformate and heavy aromatics streams were blended. The overall yields at this condition are included in Table I.

Comparative Example B

The pilot plant configuration of Example 1 was retained, but no inter-stage distillation was practiced. Whole first stage reformate was fed directly to the second stage without removal of the heavy aromatics. Because deactivation of the second stage catalyst was so severe in this case, the target 102 RONC could not be maintained by increasing furnace firing for the second stage. Results are summarized in Table I.

TABLE I

| OVERALL | Comp. Ex. A Conventional Reformer | Example 1 2 Stage Reformer with interstage distillation | Comp. Ex. B 2 Stage Reformer w/o distillation |
|---|---|---|---|
| Octane, RONC | 102 | 102 | 98 |
| $C_5+$ Yield, LV % | 70.6 | 76.1 | 80.3 |
| $H_2$ Yield, Wt. % | 1.5 | 2.5 | 2.3 |

It is clear that two stage operation with interstage distillation gives superior performance as compared with either conventional reforming or the case without interstage separation of heavy aromatics. In the latter case, if target 102 RONC had been achievable, the expected $C_5+$ liquid yield would have been about 74 LV %, but in fact that case is not feasible from an operability standpoint.

What is claimed is:

1. A process for catalytically reforming a gasoline boiling range hydrocarbonaceous feedstock in the presence of hydrogen in a reforming process unit comprised of a plurality of serially connected reactors, wherein each of the reactores contains a supported noble metal-containing reforming catalyst composition, the process comprising:

(a) conducting the reforming in two or more stages comprised of one or more reactors;

(b) separating aromatics possessing nine carbon atoms or more from at least a portion of the reaction stream at each stage thereby resulting in a stream rich in $C_9+$ aromatics and a stream rich in lighter aromatics and paraffins;

(c) passing at least a portion of the stream rich in lighter aromatics and paraffins to the next downstream stage, in the substantial absence of non-reformed feed; and (d) wherein the reforming of one or more of the downstream stages is conducted such that at least one of the reactors contains a reforming catalyst selected from (i) a supported mono-metallic or multi-metallic catalyst wherein at least one of the metals is a noble metal, and the support is alumina, and wherein at least one reactor of a downstream stage is operated in the substantial absence of steam, and at a pressure which is at least 25 psig lower than that of the first stage.

2. The process of claim 1 wherein the one or more reactors of the downstream stages is operated at a pressure of 200 psig or lower.

3. The process of claim 1 wherein the one or more reactors of the downstream stages are operated at a pressure of 100 psig or lower.

4. The process of claim 1 wherein the separation of the heavy aromatics stream is accomplished by use of distillation towers.

5. The process of claim 4 wherein one or more of the reactors of the downstream stages are operated at a pressure of 200 psig or lower.

6. The process of claim 4 wherein one or more of the reactors of the downstream stages are operated at pressure of 100 psig or lower.

7. The process of claim 4 wherein the reforming catalyst composition in one or more of the reactors is comprised of: platinum, a halide, and optionally at least one metal selected from Group VIII noble metals, Group IIIA, IVA, IB, VIB, and VIIB, and an inorganic oxide support.

8. The process of claim 7 wherein the reforming catalyst composition is comprised of a platinum and one or more Group VIII noble metals, a halide, and an inorganic oxide support.

9. The process of claim 4 wherein the reforming catalyst composition in one or more of the reactors is comprised of: platinum, a halide and at least one other metal selected from Group VIII noble metals or Groups IIIA, IVA, IB, VIB, and VIIB, and an inorganic oxide support.

10. The process of claim 1 wherein one or more of the downstream stages are operated such that the hydrogen-rich gaseous product is not recycled.

11. The process of claim 4 wherein one or more of the downstream stages are operated such that the hydrogen-rich gaseous product is not recycled.

12. The process of claim 8 wherein one or more of the downstream stages are operated such that they hydrogen-rich gaseous product is not recycled.

13. The process of claim 12 wherein the first stage is operated in semi-regenerative mode and the second stage is operated in cyclic mode.

14. The process of claim 1 wherein one or more of the reactors are operated in continuous mode.

15. The process of claim 4 wherein one or more of the reactors is operated in continuous mode.

16. The process of claim 4 wherein $C_6$–$C_8$ aromatics are also separated from the reaction stream from the last stage.

17. The process of claim 1 wherein the number of stages is two.

18. The process of claim 17 wherein heavy aromatics are separated from the reaction product stream from any one or more of the stages and at least a portion of the resulting heavy aromatics-lean stream is recycled to any one or more of the stages.

19. The process of claim 17 wherein a portion of the reaction product stream from stage two is recycled to the fractionator between stages one and two.

20. The process of claim 1 wherein a portion of the reaction product stream from any one or more of the stages is recycled to the fractionator between any one or more of the stages.

21. The process of claim 17 wherein the second stage is operated such that gaseous product is not recycled.

22. The process of claim 18 wherein the first stage is operated in semi-regenerative mode and the second stage is operated in cyclic mode.

23. A process for catalytically reforming a gasoline boiling range hydrocarbonaceous feedstock in the presence of hydrogen in a reforming process unit comprised of a plurality of serially connected reactors wherein each of the reactors contains a noble-metal catalyst composition comprised of at least one noble metal, and on alumina support, said process comprising:

(a) conducting the reforming in two stages which are separated from each other by a heavy aromatics separation unit which accomplishes separation of $C_9+$ aromatics by fractionation, wherein each stage includes one or more reactors;

(b) separating, in the heavy aromatics separation unit, at least a portion of the reaction product stream between stages into a $C_9+$ or $C_{10}+$ aromatics-rich stream and a $C_9+$ or $C_{10}+$ aromatics-lean stream, wherein at least a portion of the $C_9+$ or $C_{10}+$ aromatics-lean stream is passed to the next stage, recycled, or collected; in the substantial absence of unreformed feed, (c) controlling the reforming severity of the first stage to achieve substantial conversion of $C_{10}+$ paraffins and naphthenes to aromatics; and (d) operating the second stage in the substantial absence of steam; and at a pressure of at least 25 psig lower than the first stage.

24. The process of claim 23 wherein the second stage is operated at a pressure of 200 psig or lower.

25. The process of claim 23 wherein the catalyst composition of one or more of the reactors is comprised of a Group VIII noble metal, a halide, and an inorganic oxide support.

26. The process of claim 23 wherein the catalyst composition is one or more of the reactors is comprised of: platinum, a halide and at least one metal selected from Group VIII noble metals, Groups IIIA, IVA, IB, VIB, and VIIB, and an inorganic oxide support.

27. The process of claim 24 wherein gaseous product from the last stage is not recycled and the firs stage is operated in semi-regenerative mode and the second stage is operated in cyclic mode.

* * * * *